US005090333A

United States Patent [19]

Bieker et al.

[11] Patent Number: 5,090,333

[45] Date of Patent: Feb. 25, 1992

[54] BOGIE FOR HIGH-SPEED RAILBORNE VEHICLE

[75] Inventors: Guido Bieker, Kirchhundem; Gerhard Kampmann, Netpen; Alfred Lohmann, Siegen-Eisern, all of Fed. Rep. of Germany

[73] Assignee: Wagon Union GmbH, Siegen, Fed. Rep. of Germany

[21] Appl. No.: 532,604

[22] Filed: Jun. 4, 1990

[30] Foreign Application Priority Data

Jun. 5, 1989 [DE] Fed. Rep. of Germany ..... 3918300

[51] Int. Cl.[5] ..... B61F 5/30

[52] U.S. Cl. ..... 105/218.1; 105/212; 105/224.05; 105/167; 105/224.1

[58] Field of Search ..... 105/218.1, 218.2, 219, 105/212, 224.05, 224.06, 224.1, 165, 167, 168, 182.1, 204, 206.1

[56] References Cited

U.S. PATENT DOCUMENTS 1,881,139 10/1932 Seidel ..... 105/218.2
3,690,271 9/1972 Hobbs ..... 105/218.1
4,067,261 1/1978 Scheffel ..... 105/168
4,589,346 5/1986 Miller ..... 105/224.05

FOREIGN PATENT DOCUMENTS 1255698 12/1967 Fed. Rep. of Germany ... 105/218.2
1605137 2/1971 Fed. Rep. of Germany ... 105/218.2
1755072 12/1971 Fed. Rep. of Germany .
2320323 12/1974 Fed. Rep. of Germany ... 105/218.1
0069313 6/1978 Japan ..... 105/218.1

*Primary Examiner*—Robert J. Oberleitner
*Assistant Examiner*—Mark T. Le
*Attorney, Agent, or Firm*—McGlew & Tuttle

[57] ABSTRACT

The present invention pertains to a bogie for high-speed railborne vehicles, in which the wheel sets are guided on the bogie frame by double leaf spring wheel forks. Stable, quiet straight travel of the bogie over straight sections at top speeds and radial adjustment of the wheel sets in rail bends at low tracking forces is achieved by arranging a a roll stabilizer damping the horizontal longitudinal movements between the axle bearing and the bogie frame between the leaf spring wheel forks of each double leaf spring wheel fork.

9 Claims, 6 Drawing Sheets

BOGIE FOR HIGH-SPEED RAILBORNE VEHICLE

FIELD AND BACKGROUND OF THE INVENTION

The present invention pertains to a bogie for high-speed railborne vehicles, in which the wheel sets are attached to and guided on the bogie frame by means of double leaf spring wheel forks acting on the axle bearings, elastic intermediate bearings are being provided between the double leaf spring wheel forks and axle bearings or bogie frame, and a vertical primary spring is arranged between each axle bearing and the bogie frame.

Bogies of the class described above are known, for example, from West German Patent No. DE-PS 17,55,072. The longitudinal beams of the bogie frame are supported via springs on axle bearing housings of the wheel sets. These axle bearing housings are guided by two spring leaf wheel forks that are arranged in different planes one above the other and are parallel to one another. The ends of the spring leaf wheel forks facing away from the axle bearing housings are rigidly connected, without clearance or friction, to a fixed block that is part of the bogie frame. An integrally cast lug extending horizontally in the longitudinal direction between the free ends of the wheel fork spring leaves, having a vertical bore expanding symmetrically in the upward and downward directions and with a bushing made of elastic material in said bore, is arranged at each axle bearing housing. Clamping rings with a conical outer jacket can be inserted from the top and bottom, concentrically to the bushing, with the small end faces of said clamping rings facing each other. The free ends of the wheel fork spring leaves are preferably pressed against the upper and lower outer larger end faces of said clamping rings by means of a necked-down bolt. The clamping rings and the free ends of the wheel fork spring leaves can be assembled into a unit supported via the bushing against the axle bearing housing. This arrangement improves the running properties of a railborne vehicle at high speeds due to the resilient support of the spring leaf wheel fork attachment to the axle bearing housing, because a certain automatic radial adjustment of the wheel sets can be achieved. Due to the arrangement of the intermediate rubber bearing, the resonance range of the bogie can be shifted into a speed range which experience has shown is surpassed in a short time on start, i.e., which does not correspond to the travel speed of the railborne vehicle. The resonance range can be accurately adjusted by fixing the clamping rings at more closely or more widely spaced locations from each other in the radial direction, so that more or less extensive deformation of the bushing consisting of elastic material takes place.

This prior art wheel set guide mechanism represents a compromise between stable, relatively quiet running of the wheel set over straight sections and curve travel running with the lowest possible wear and force, because longitudinally rigid wheel set guiding leads to only a small radial adjustment of the wheel sets in the curve while ensuring high stability of travel over straight sections. The stability of travel and consequently the top speed are very substantially reduced in the case of a longitudinally soft wheel set which is provided for guiding in order to achieve substantially improved radial adjustment of the wheel sets and weak tracking forces in curves. Consequently, to reach high speed over straight sections, the most rigid possible longitudinal connection of the wheel sets is selected. This in turn leads to poorer radial adjustment of the wheel sets on curves and consequently to stronger tracking forces and increased wheel flange wear. However, if the radial adjustment of the wheel sets is to be improved, reduction of the stable, quiet straight travel of the wheel sets over straight sections and consequently lower top speed must be accepted.

SUMMARY AND OBJECTS OF THE INVENTION

It is an object of the present invention to eliminate the above-mentioned disadvantageous running characteristics in straight sections and in rail bends in a bogie of the class mentioned in the introduction by appropriate, simple design measures and to achieve radial adjustment of the wheel sets in rail bends with weak tracking forces along with stable, quiet straight travel in straight sections at top speeds.

According to the present invention, this task is accomplished in a bogie of the class described in the introduction by arranging a roll stabilizer, damping the horizontal longitudinal movements between the axle bearing and the bogie frame between the spring leaf wheel forks of each double leaf spring wheel fork. According to an exemplified embodiment of the present invention, the roll stabilizer may be designed as a double-acting hydraulic damper. According to other exemplified embodiments of the present invention, the roll stabilizer is designed as a friction damper. If a hydraulic damper is used as a roll stabilizer, one end of it is attached to the axle bearing and its other end is attached to the bogie frame. If a friction damper is used as the roll stabilizer, it is designed, according to an exemplified embodiment, as a damper acting between the spring leaf wheel forks on the bearing of the double leaf spring wheel fork and is provided with the elastic intermediate bearing. The friction damper is fastened to the double spring leaf wheel fork, on one hand, and to the axle bearing or the bogie frame, on the other hand.

In a third exemplified embodiment, the friction damper consists of at least two leaf springs which are adjustably tensioned against each other and whose long ends are in contact, on both sides, with friction surfaces of the axle bearing housing and/or bogie frame arranged in the longitudinal direction of the bogie.

Soft design of the elastic intermediate bearing makes it possible to achieve nearly ideal radial adjustment of the wheel sets down to the smallest curve radius of 250 m used in long-distance passenger transportation, with good, uniform distribution of the wheel set guiding forces on the front and trailing wheel sets. The design of the bogie according to the present invention also permits higher travel speeds in larger curves, because there are sufficient reserves for absorbing dynamic guiding forces as a consequence of inaccuracy of the track position. The wheel flange wear is markedly reduced. By providing the roll stabilizer, the wheel set guiding forces needed for stable, quiet running of the wheel set over straight sections are obtained.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENTS

Figure 1:
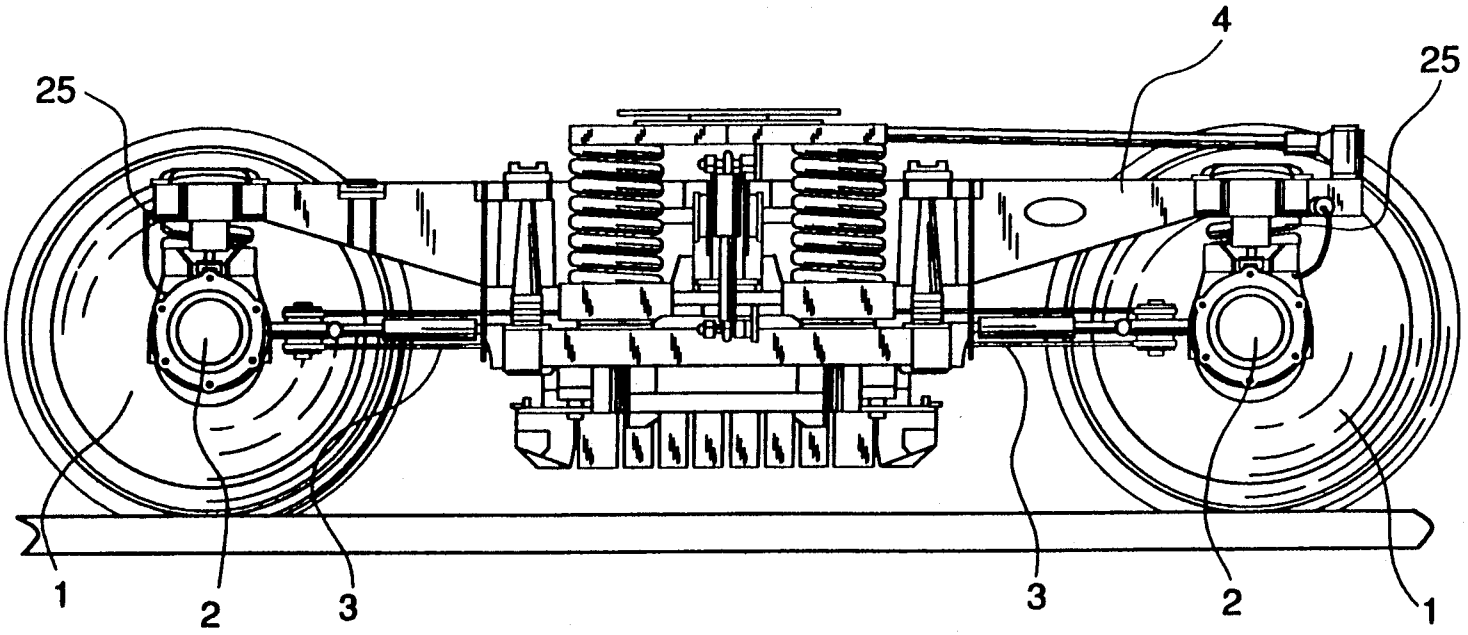
FIG. 1 is a side view of a bogie for high-speed railborne vehicles according to the present invention.

The wheel sets 1 of the bogie are attached to and guided on bogie frame 4 via their axle bearings 2 and vertical primary springs 25 and double leaf spring wheel forks 3 arranged horizontally on said bearings. The two spring leaf wheel forks of each double spring leaf wheel fork 3 are attached adjustably via tooth racks 5 and rigidly to the bogie frame 4. The spring leaf wheel fork elements of each double leaf spring wheel fork 3 are also attached to the axle bearing 2 adjustably via tooth racks 6 but via elastic lining plates 7. Said elastic lining plate, such as an arrangement formed of intermediate rubber layers, 7 can be correctly pretensioned via a necked-down bolt 8 which fastens the two spring leaf wheel forks on the axle bearing housing. The horizontal longitudinal rigidity of the intermediate rubber layer 7 can in turn be correctly adjusted by properly selecting the pre-tensioning of said necked-down bolt 8. A hydraulic damper 9, one end of which is hinged to said bogie frame 4 and whose other end is hinged to said axle bearing 2, is arranged between the two spring leaf wheel forks of said double leaf spring wheel fork 3. Said hydraulic damper, which is designed as a double-acting damper, thus acts between the bogie frame and the axle bearing housing in the horizontal longitudinal direction.

Figure 2:
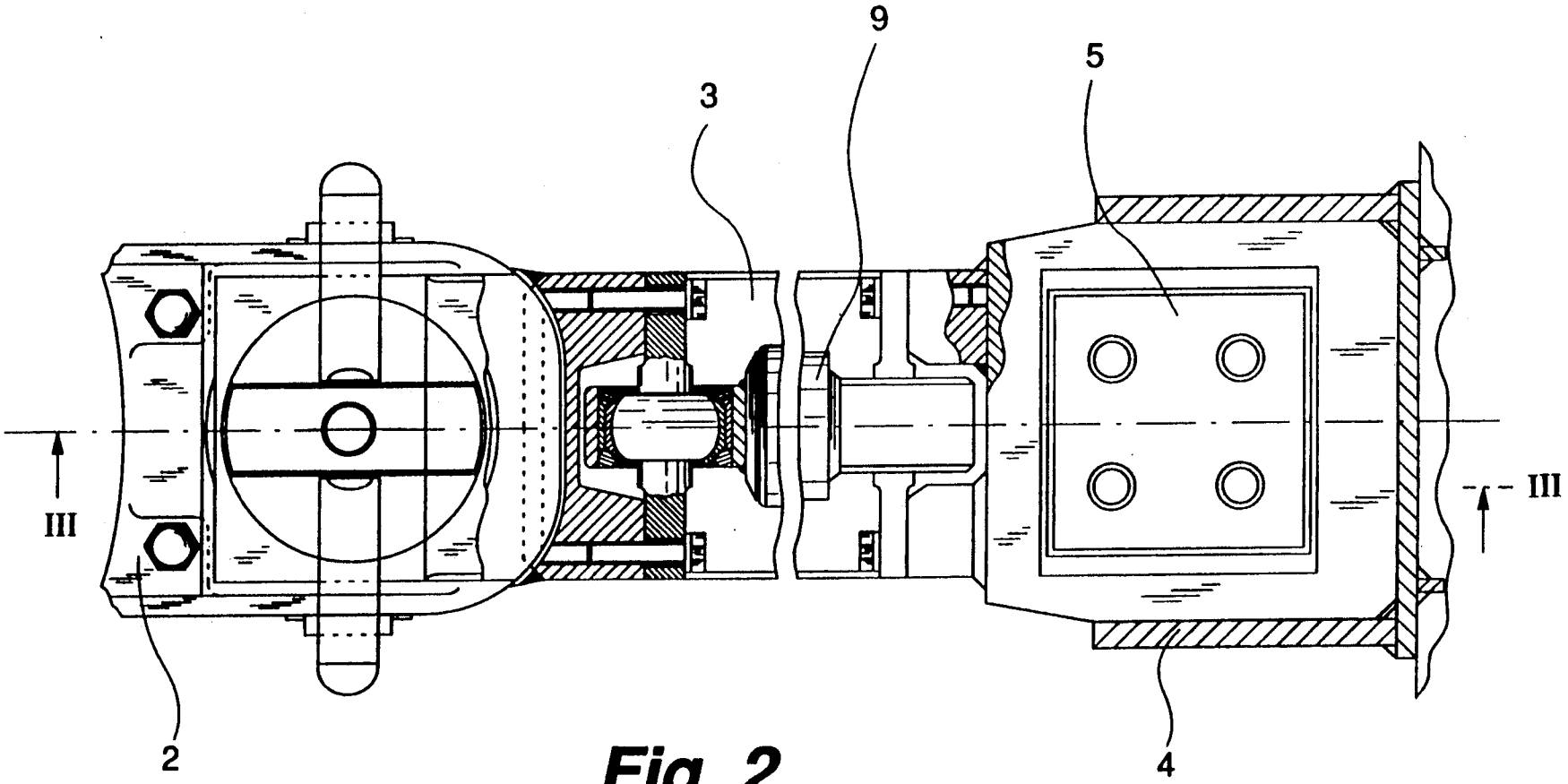
FIG. 2 is a top view, partly in section, showing an enlarged representation of the wheel set guiding mechanism of the bogie according to FIG. 1 according to a first embodiment of the present invention.
Figure 3:
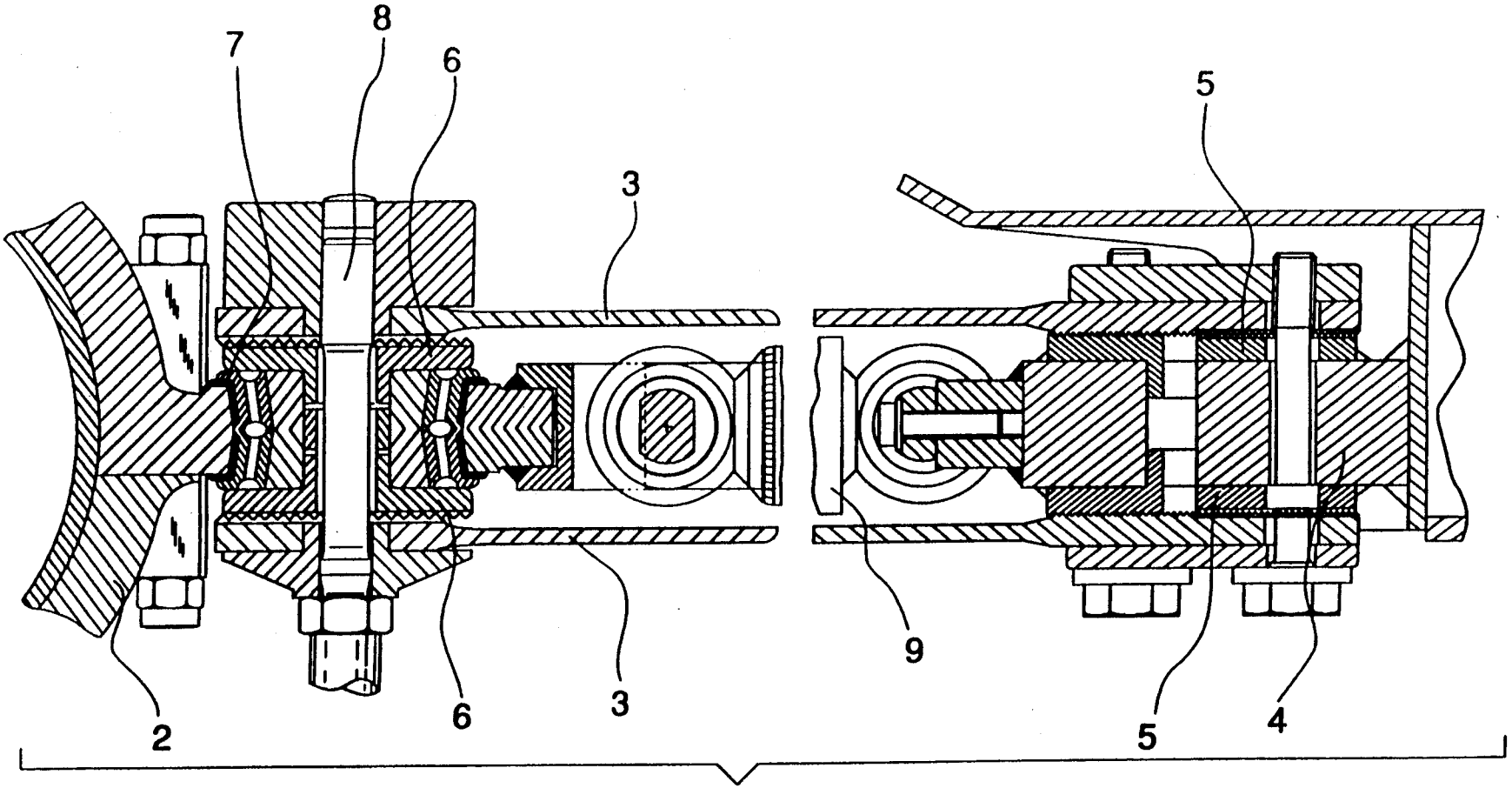
FIG. 3 is a sectional view taken along line III—III in FIG. 2.
Figure 4:
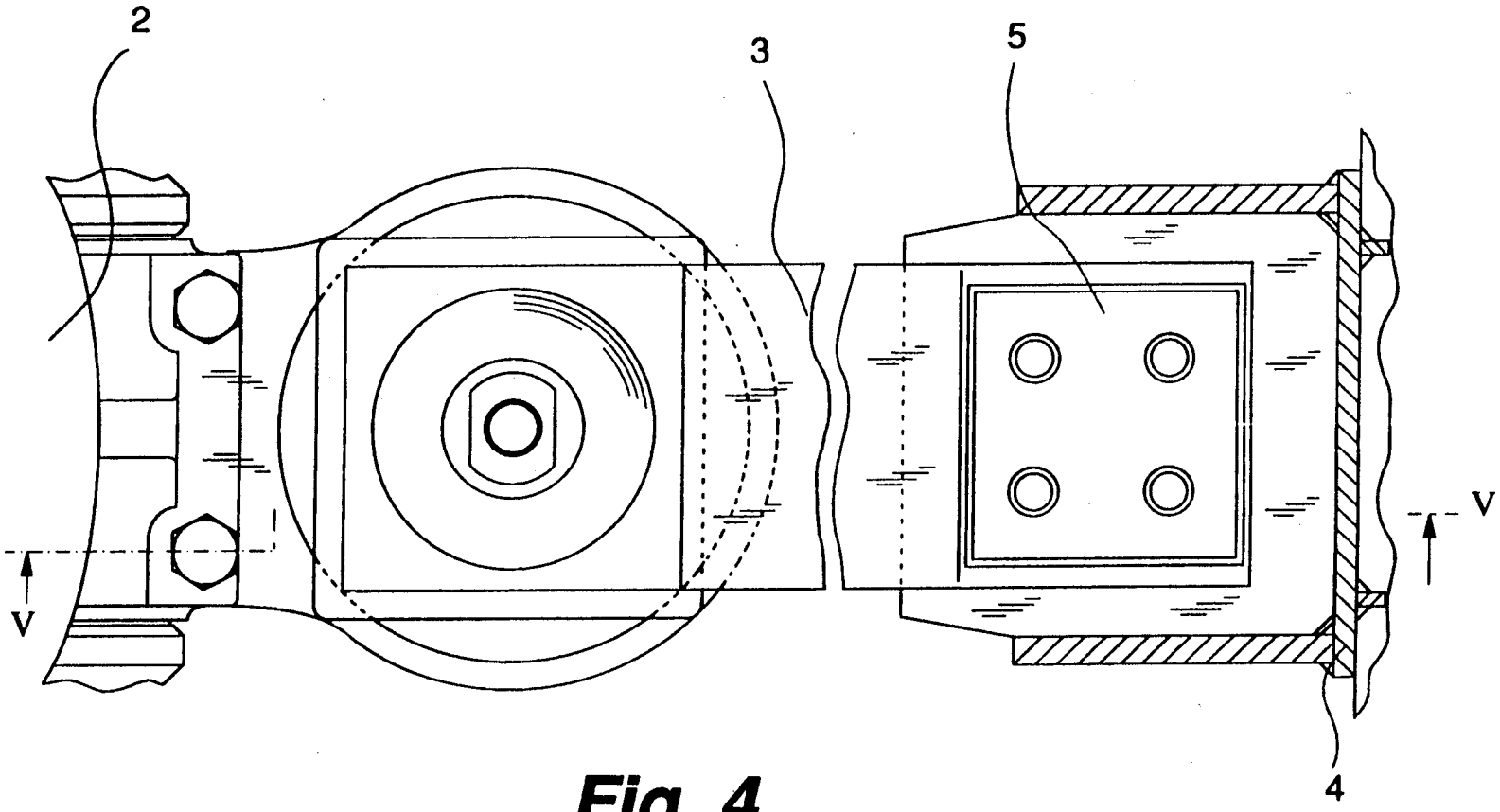
FIG. 4 is a partly sectional view similar to FIG. 2, showing a second embodiment of the present invention.
Figure 5:
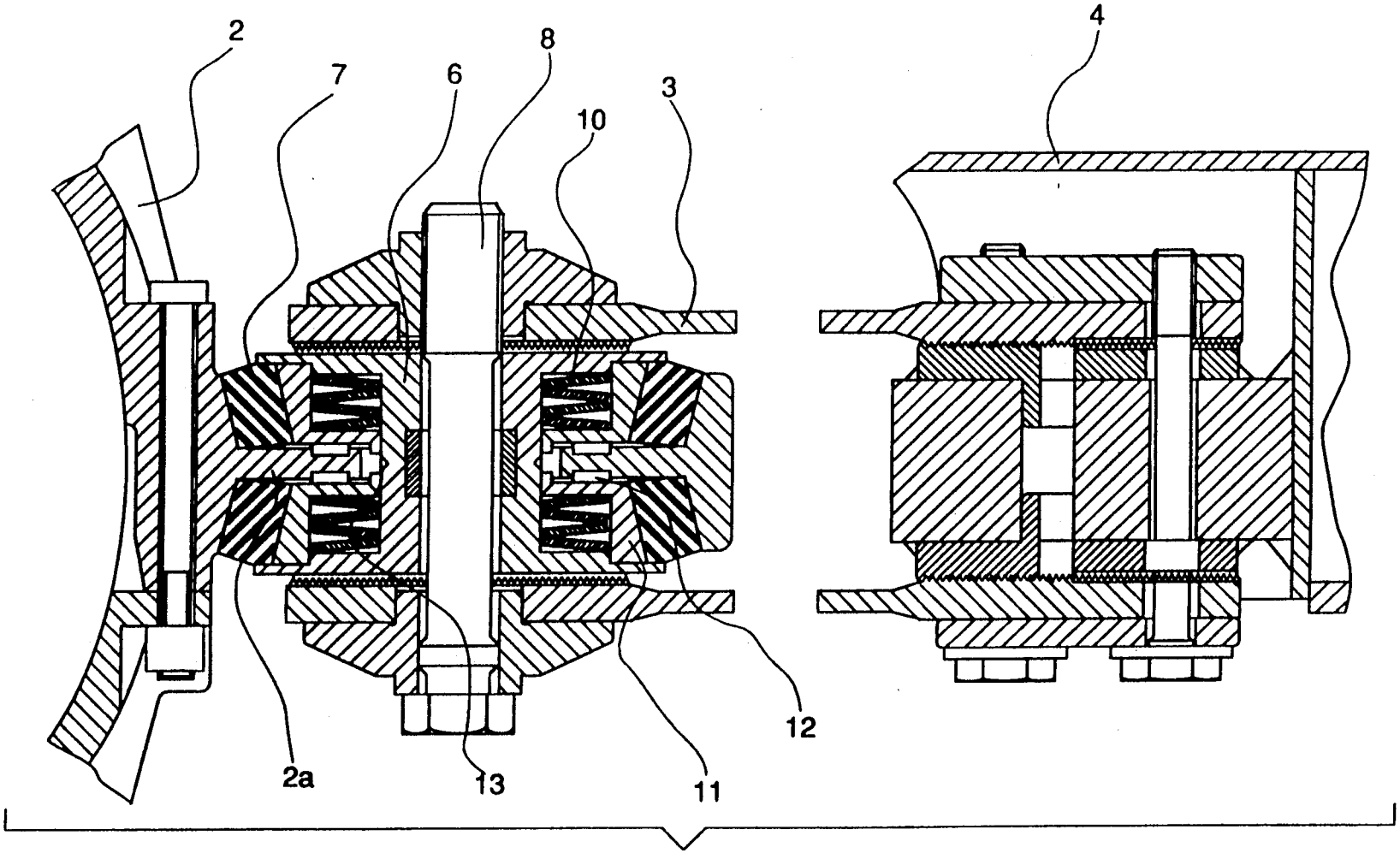
FIG. 5 is a the sectional view taken along line V—V in FIG. 4.

In the embodiment of the present invention shown in FIGS. 4 and 5, the wheel set is also connected horizontally to and guided on said bogie frame 4 via said axle bearing housing 2 and said double leaf spring wheel fork 3. Said double leaf spring wheel fork 3 is fastened to said bogie frame 4 and said axle bearing 2 as in the embodiment of the present invention shown in FIGS. 2 and 3. Elastic intermediate bearings 7 are also arranged between said tooth racks 6 and said axle bearing housing 2. In this embodiment of the present invention, plate springs 10, which press friction rings 11 on both sides against friction linings 12 of the flange 2a of said axle bearing housing 2, are provided between said tooth racks 6 and said horizontal flange 2a of said axle bearing housing 2. Said plate springs 10 and consequently the pressing force of said friction surface 11 on said friction lining 12 can be adjusted via said necked-down bolt 8. Said tooth racks 6 and said necked-down bolt 8 are guided with clearance in a bore 13 of said flange 2a of said axle bearing housing 2, so that the necessary swing-out of the wheel set with said axle bearing 2 is possible during the radial adjustment of the wheel set during travel on curves.

Figure 6:
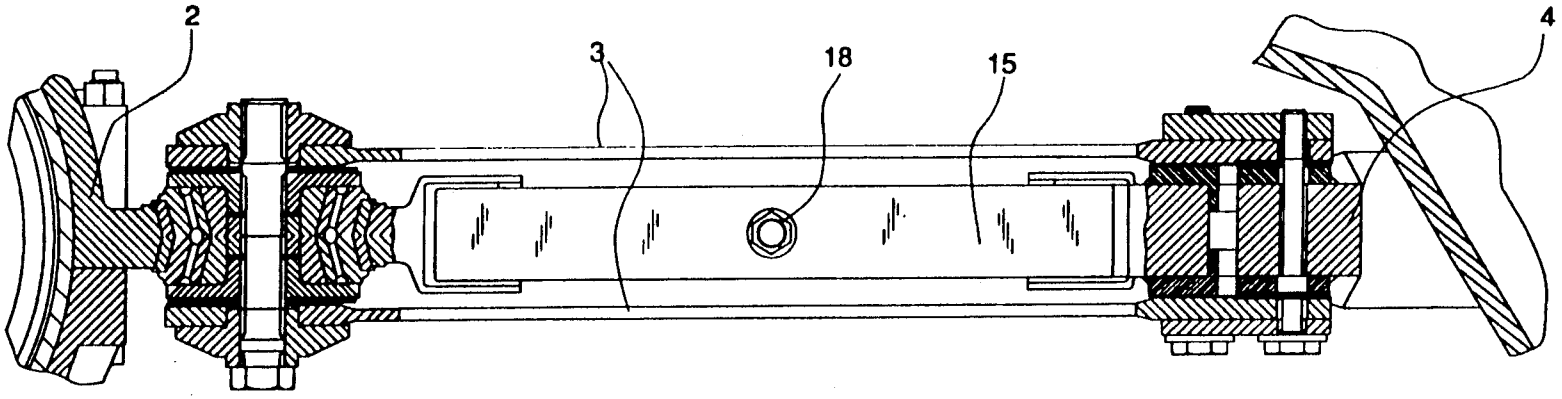
FIG. 6 is a vertical longitudinal sectional view taken through the wheel set guiding mechanism of the bogie according to a third embodiment of the present invention.
Figure 7:
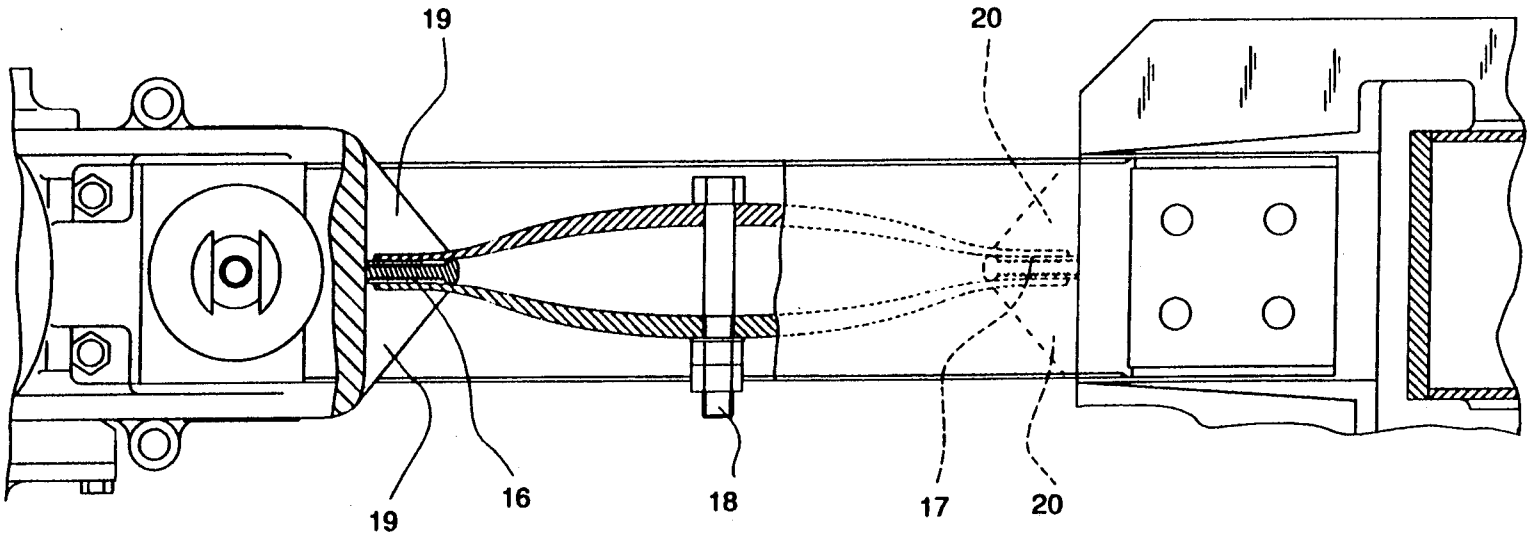
FIG. 7 is a top partially sectional view of the wheel set guiding mechanism according to FIG. 6.

In the embodiment of the present invention shown in FIGS. 6 and 7, said wheel set 1 is again fastened horizontally to and guided on said bogie frame 4 via said axle bearing housing 2 and said double leaf spring wheel fork 3. Two arched spring leaves 15, which are in contact laterally, at their longitudinal ends, with friction surfaces 16 of said axle bearing housing 2, and with friction surfaces 17 of said bogie frame 4, are provided between the two leaves of the double leaf spring wheel forks. The friction surfaces 16 are arranged in the longitudinal direction of the bogie. Said friction surfaces 16 and 17 are preferably provided with a friction lining. In the middle of their lengths, said two spring leaves 15 are tensioned against each other by means of a set screw 18 so that a defined contact pressure on said friction surfaces 16 and 17 is generated. Said spring leaves 15 are guided by lateral guide webs 19 of said axle bearing housing 2 and guide webs 20 of said bogie frame.

While a specific embodiment of the invention has been shown and described in detail to illustrate the application of the principles of the invention, it will be understood that the invention may be embodied otherwise without departing from such principles.

What is claimed is:

1. A bogie construction for high-speed railborne vehicles, comprising:

a bogie frame, wheel sets, with each wheel set including axle bearings;

double leaf spring wheel forks including double leaf spring wheel fork elements, connecting said wheel sets to said bogie frame;

intermediate rubber bearing elements positioned between each said double leaf spring wheel fork and one of said axle bearings and said bogie frame;

a vertical primary spring positioned between each axle bearing and said bogie frame; and, roll stabilizer means positioned between each axle bearing and said bogie frame and positioned between said leaf spring wheel fork elements of each double leaf spring wheel fork for damping horizontal movement resulting from horizontal play provided by said intermediate rubber bearing elements.

2. A bogie construction according to claim 1, wherein said roll stabilizer means includes a double-acting hydraulic damper.

3. A bogie construction according to claim 1, wherein said roll stabilizer means includes a friction dampening arrangement including engaging friction elements.

4. A bogie construction according to claim 2, wherein each hydraulic dampener is fastened to one of said axle bearings at one end and fastened to said bogie frame at another end.

5. A bogie construction according to claim 3, wherein said friction damper arrangement is positioned between said leaf spring fork elements, said friction damper arrangement acting on a bearing provided with an elastic intermediate bearing of said double leaf spring wheel fork.

6. A bogie construction according to claim 3, wherein said friction dampener arrangement is fastened to said double leaf spring wheel fork at one end and fastened to one of said axle bearing and said bogie frame at another end.

7. A bogie construction according to claim 3, wherein said friction damper arrangement includes at least two leaf springs positioned adjustably compressed against each other, said leaf springs each having an axial bearing end in contact with one of said friction elements, and having a bogie frame end in contact with another of said friction elements.

8. A bogie construction for high-speed railborne vehicles, comprising:

a bogie frame, wheel sets, with each wheel set including axle bearings;

double leaf spring wheel forks including double leaf spring wheel fork elements, connecting said wheel sets to said bogie frame;

intermediate rubber bearing elements positioned between each said double leaf spring wheel fork and one of said axle bearings and said bogie frame;

a vertical primary spring positioned between each axle bearing and said bogie frame; and, roll stabilizer means positioned between each axle bearing and said bogie frame and positioned between said leaf spring wheel fork elements of each double leaf spring wheel fork, including at least two leaf springs positioned adjustably compressed against each other, said leaf springs each having an axial bearing end including axial bearing end friction element, and a bogie frame end including bogie frame end friction element, each axial bearing end of said leaf spring being in contact with said axial bearing friction element and each of said bogie frame spring ends being in contact with said bogie frame friction element.

9. A bogie construction for high-speed railborne vehicles, comprising:

a bogie frame, wheel sets, each of said wheel sets including axle bearings;

double leaf spring wheel forks connection said wheel sets to said bogie frames;

intermediate rubber bearing means, positioned between each said double leaf spring wheel fork and one of said axle bearings and said bogie frame for providing horizontal movement adjustment of axles;

a vertical primary spring positioned between each axle bearing and said bogie frame; and roll stabilizer means positioned between each axle bearing and said bogie frame and positioned between said leaf spring wheel fork elements of each double leaf spring wheel fork, for damping said horizontal movement.

* * * * *